US006645123B1

(12) United States Patent
Davis

(10) Patent No.: US 6,645,123 B1
(45) Date of Patent: Nov. 11, 2003

(54) JUMP ROPE APPARATUS

(76) Inventor: Lesia M. Davis, 14 Winter St., Hyde Park, MA (US) 02136

( * ) Notice: Subject to any disclaimer, the term of this patent is extended or adjusted under 35 U.S.C. 154(b) by 0 days.

(21) Appl. No.: 10/164,956

(22) Filed: Jun. 6, 2002

(51) Int. Cl.[7] ..... A63B 5/22
(52) U.S. Cl. ..... 481/81
(58) Field of Search ..... 482/81, 82, 127, 482/126, 148, 121; 434/247

(56) References Cited

U.S. PATENT DOCUMENTS

| | | | | | |
|---|---|---|---|---|---|
| 2,911,063 | A | * | 11/1959 | Wolfson | 482/81 |
| 3,595,571 | A | * | 7/1971 | Spinnett | 482/81 |
| 4,647,037 | A | * | 3/1987 | Donohue | 482/81 |
| 6,464,621 | B1 | * | 10/2002 | Chen | 482/83 |

* cited by examiner

*Primary Examiner*—Jerome W. Donnelly

(57) ABSTRACT

The present invention is for an apparatus which provides an automatic method for turning both ends of jump rope. Providing a hands free method for turning a jump rope eliminates the need for parents or other children to turn the rope manually. This allows children to enjoy jumping rope even while playing alone and prevents arguments over whose turn it is to twirl the rope when playing in a group. The automatic jump rope apparatus consists of a pair of poles which are spiked on the bottom and fit in weighted bases so that they provide stability on flat surfaces and can be removed from the bases and driven into the ground to provide stability on uneven surfaces. One pole holds one end of the rope and allows it to be turned as rotational force is applied to the other end of the rope by a spring loaded crank assembly located on the opposite pole. The user would simply crank the unit and then hit a release lever to enable the unit to rotate, thus swinging the jump rope between the two poles. The spring loaded crank assembly could be replaced by a battery powered motor which would provide the rotational force necessary to turn the rope.

3 Claims, 2 Drawing Sheets

JUMP ROPE APPARATUS

BACKGROUND OF THE INVENTION

1. Field of the Invention

The present invention relates to a jump rope apparatus for use in connection with a conventional jump rope. The jump rope apparatus has particular utility in connection with providing a means for turning a jump rope for a single user, thereby eliminating the need for parents or other children to grip the handles of the jump rope and turn it manually.

2. Description of the Prior Art

Rope jumping has been universally enjoyed for decades as a means for exercise and recreation. The least enjoyable task, when a group of children engages in jumping rope, is that of twirling the rope while the others jump. This task usually requires two children, who are thus only passively involved in the play, while the other children actively enjoy the game and engage in maneuvers such as jumping in and out, touching the ground, and different types of footwork.

Although one person can jump rope by himself, the jumper's movements are either limited or, in the case of tricks that involve the use of the hands, prevented by the requirement that the hands be used to twirl the rope. Additionally, when a child wants to jump rope at home, the parents or siblings are typically involved in twirling the rope. If the parents or siblings are unavailable or unwilling, the child must jump rope by himself.

The use of an automated jump rope apparatus is known in the prior art. For example, U.S. Pat. No. 5,167,599 to Anne L. Haller discloses a jump rope apparatus that consists of a telescoping base with a support arm that permits rotation of an attached jump rope. However, the Haller '599 patent provides no mechanical way of turning the rope and requires one participant to turn the end of the rope that is not connected to the device.

U.S. Pat. No. 4,739,985 to Elliot A. Ruddell, George Foster, and Joe Cernansky discloses a mechanized jump rope apparatus that employs a powered crank at one end of a rope while the other end of the rope is attached to a stationary structure. However, the Ruddell, et al. '985 patent does not provide a means for jumping rope if there is no stationary structure available, such as in an open field or on a beach. Furthermore, the Ruddell, et al. '985 device has the drawback of requiring a power supply to operate the device. Electrical outlets are not typically found in good jump roping areas, and batteries can be expensive to continually replace.

Similarly, U.S. Pat. No. Des. 191,584 to Ronald W. Tannahill discloses the ornamental design for a motor driven jump rope. However, the Tannahill '584 patent does not provide a means to stabilize the base on uneven ground and has the further drawback of requiring an electrical power supply to operate the device. Electrical outlets are not typically found in good jump roping areas, and batteries can be expensive to continually replace.

U.S. Pat. No. 3,770,268 to Leo J. Castello discloses an automatic jumping device that can be manually or electrically powered. However, the Castello '268 patent does not provide a means for turning both ends of a jump rope and requires one participant to turn the end of the rope that is not connected to the device.

Likewise, U.S. Pat. No. 5,464,376 to Estella D. Weston and Gwennette Y. Cummings discloses a battery powered motorized jump rope apparatus that can turn multiple jump ropes. Flowever, the Weston, et al. '376 device relies on batteries as its sole means of power which can be extremely expensive depending on the frequency and longevity of use of the device.

Lastly, U.S. Pat. No. 5,961,425 to Tahira Reid and Andrew Burdick discloses a jump rope device that is motor driven and consists of a pair of stations that turn multiple jump ropes. However, the Reid, et al. '425 patent deals mainly with turning multiple ropes, resulting in a complex device that would drive up the cost of the unit. Additionally, the Reid, et al. '425 device requires an electrical power supply for operation and provides no manual means of operation.

While the above-described devices fulfill their respective, particular objectives and requirements, the aforementioned patents do not describe an automatic jump rope apparatus that can be manually or battery powered and allows a hands-free approach to jumping rope. Both the Haller '599 and the Castello '268 patents fail to provide a mechanical way of turning the rope and require one participant to turn the end of the rope that is not connected to the device. The Ruddell, et al. '985, Tannahill '584, Weston, et al. '376, and Reid, et al. '425 devices, require a power supply for operation. Electrical outlets are not typically found in good jump roping areas, and batteries can be expensive to continually replace. Furthermore, the Ruddell, et al. '985 patent does not provide a means for jumping rope if there is no stationary structure available, such as in an open field or on a beach, to which one end of the jump rope can be attached. Another drawback of the Tannahill '584 patent is that it does not provide a means to stabilize the base on uneven ground. Finally, the Reid, et al. '425 patent reveals a complex device which would drive cost of the unit beyond the range of many potential consumers.

Therefore, a need exists for a new and improved automatic jump rope apparatus that can be used for engaging in hands free rope jumping. In this regard, the present invention substantially fulfills this need. In this respect, the automatic jump rope apparatus according to the present invention substantially departs from the conventional concepts and designs of the prior art, and in doing so provides an apparatus primarily developed for the purpose of allowing any number of users to enjoy hands free rope jumping.

SUMMARY OF THE INVENTION

In view of the foregoing disadvantages inherent in the known types of automatic jump rope apparatus now present in the prior art, the present invention provides an improved automatic jump rope apparatus, and overcomes the above-mentioned disadvantages and drawbacks of the prior art. As such, the general purpose of the present invention, which will be described subsequently in greater detail, is to provide a new and improved automatic jump rope apparatus which has all the advantages of the prior art mentioned heretofore and many novel features that result in a automatic jump rope apparatus which is not anticipated, rendered obvious, suggested, or even implied by the prior art, either alone or in any combination thereof.

To attain this, the present invention essentially comprises a pair of vertical support poles with weighted bases. A crank operated spring loaded assembly is located on one pole, and a swivel unit is located on the other pole. The spring loaded assembly has a key that allows the user to maintain the tension placed on the spring assembly until the he pulls the control handle. The support poles have spiked ends such that they can be removed from the weighted bases and inserted into the ground. A second embodiment of this invention includes replacing the crank operated spring loaded assembly with a motorized unit.

There has thus been outlined, rather broadly, the more important features of the invention in order that the detailed description thereof that follows may be better understood and in order that the present contribution to the art may be better appreciated.

The invention may also include an activation and variable speed control switch for the motorized version. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automatic jump rope apparatus that has all of the advantages of the prior art automatic jump rope apparatus and none of the disadvantages.

It is another object of the present invention to provide a new and improved automatic jump rope apparatus that may be easily and efficiently manufactured and marketed.

An even further object of the present invention is to provide a new and improved automatic jump rope apparatus that has a low cost of manufacture with regard to both materials and labor, and which accordingly is then susceptible of low prices of sale to the consuming public, thereby making such jump rope apparatus economically available to the buying public.

Still another object of the present invention is to provide a new automatic jump rope apparatus that provides in the apparatuses and methods of the prior art some of the advantages thereof, while simultaneously overcoming some of the disadvantages normally associated therewith.

Even still another object of the present invention is to provide an jump rope apparatus for hands free twirling of a jump rope. This allows a single user to engage in avariety of jump rope activities by eliminating the need for parents or other children to grip the handles of the jump rope and turn it manually.

Yet another object of the present invention is to provide an automatic jump rope apparatus that is offered in both a manual and a motorized version.

Still yet another object of the present invention is to provide an jump rope apparatus that can be used on flat surfaces such as pavement, concrete, gym floors, and stages, as well as on uneven surfaces such as beaches, parks, and backyards.

Lastly, it is an object of the present invention to provide a new and improved jump rope apparatus that increases the enjoyment of jump rope games by a group of children through eliminating the necessity that they turn the rope.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
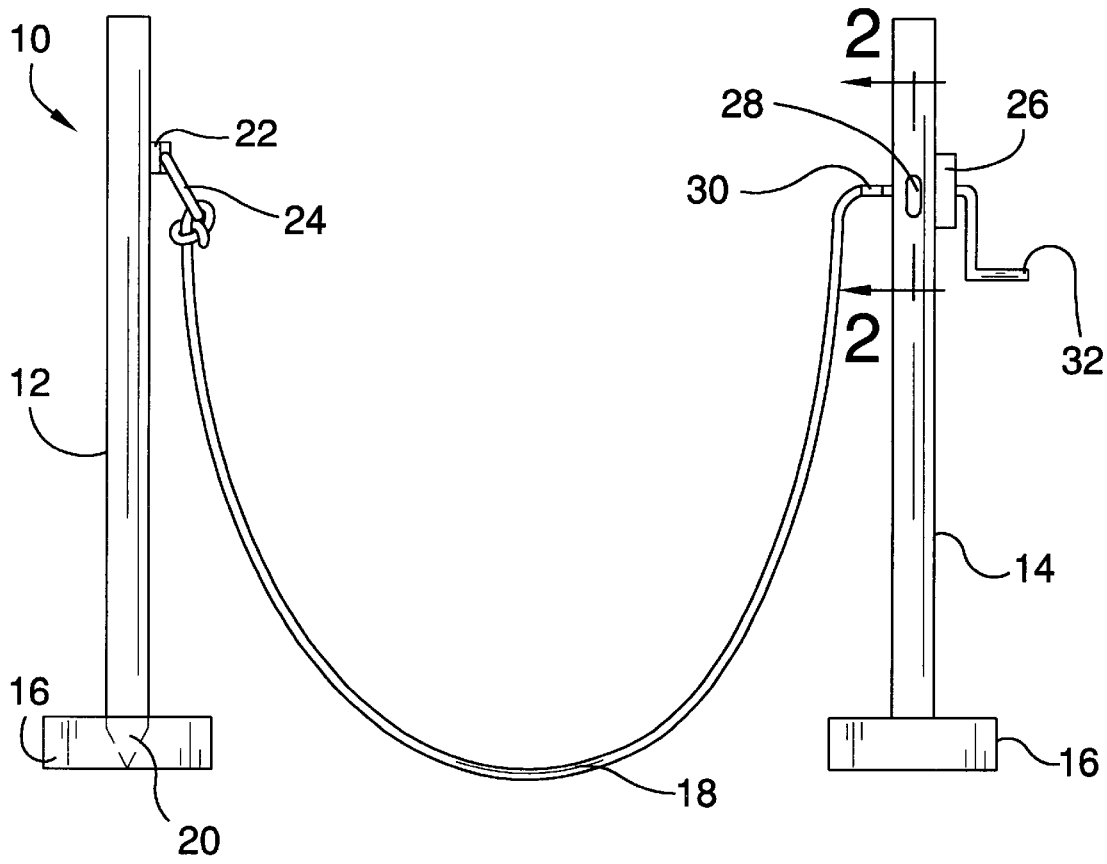
FIG. 1 is a front elevation view of the preferred embodiment of the automatic jump rope apparatus constructed in accordance with the principles of the present invention.
Figure 2:
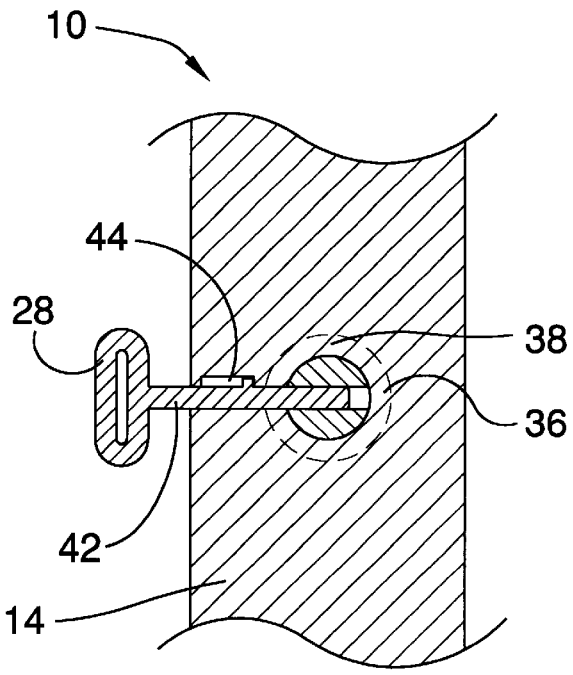
FIG. 2 is a side sectional view of the control handle of the spring assembly of the present invention.
Figure 3:
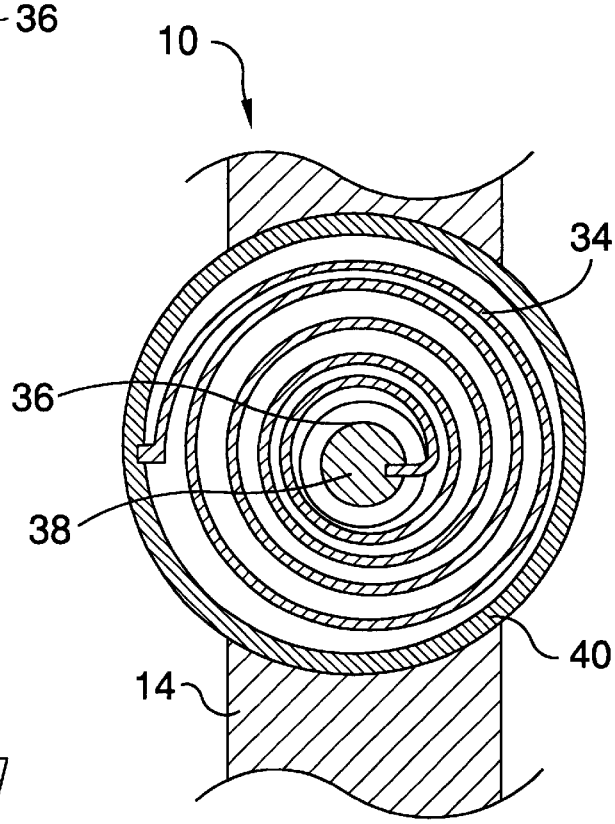
FIG. 3 is a side sectional view of the spring assembly of the present invention.
Figure 4:
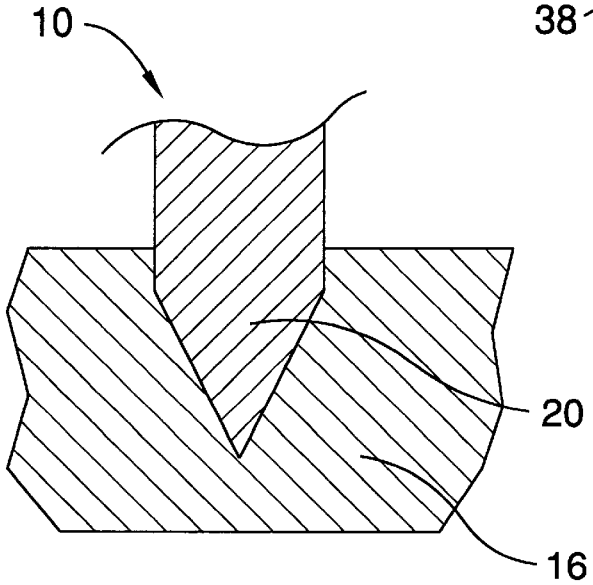
FIG. 4 is a front sectional view of the base portion of the present invention.

Referring now to the drawings, and particularly to FIGS. 1–5, a preferred embodiment of the jump rope apparatus of the present invention is shown and generally designated by the reference numeral 10. In FIG. 1, a new and improved automatic jump rope apparatus 10 of the present invention for hands free jump roping is illustrated and will be described. More particularly, the jump rope apparatus 10 has pair of cylindrical plastic poles, a stationary pole 12 and a rotation pole 14, each with a wide, weighted base 16 on the bottom. The stationary pole 12 is responsible for holding one end of the jump rope 18 stationary while the jump rope 18 is turning, and the rotation pole 14 is responsible for turning the jump rope 18. The poles, 12 and 14, could be formed with a spike 20 on the bottom end so they could be driven into the ground for stabilization on uneven surfaces. The spike 20 would fit into the center of the base 16, as is shown in FIG. 4, so that both options are available to the user. Near the top of the stationary pole 12 is a swivel unit 22 that allows the jump rope 18 to turn on the end attached to the stationary pole 12. The jump rope 18 is tied to a metal loop 24 that protrudes from the swivel unit 22. Directly across from the swivel unit 22 is a spring assembly 26 on the rotation pole 14. The spring assembly 26 has a control handle 28 that controls when the tension in the spring assembly 26 is released so that the jump rope 18 is turned. The jump rope 18 is attached to the rotation pole 14 through a metal connector 30. Tension on the spring assembly 26 is achieved through rotation of a crank 32 that is attached to the spring assembly 26.

FIGS. 2 and 3 deal with the internal workings of the spring assembly 26. FIG. 2 is a side sectional view of the control handle 28 of the spring assembly 26, and FIG. 3 is a top sectional view of the spring assembly. The spring assembly 26 contains a coil spring 34 wound around a bearing 36 through which the shaft 38 of the crank 32 passes. The spring assembly 26 is covered by a cylindrical housing 40. After the crank 32 is rotated to place the coil spring 34 under tension, the placement of the control handle 28 determines whether or not the tension is released to turn the jump rope 18. The handle is connected to a pin rod 42 which passes through a keyed opening in the shaft 38. Located on the pin rod 42 is a stop 44 which is responsible for catching and holding the coil spring 34 when the control handle 28 is pushed into the opening. When the control handle 28 is pulled out, the coil spring 34 is released, and the rotational energy transfers to the jump rope 18.

Figure 5:
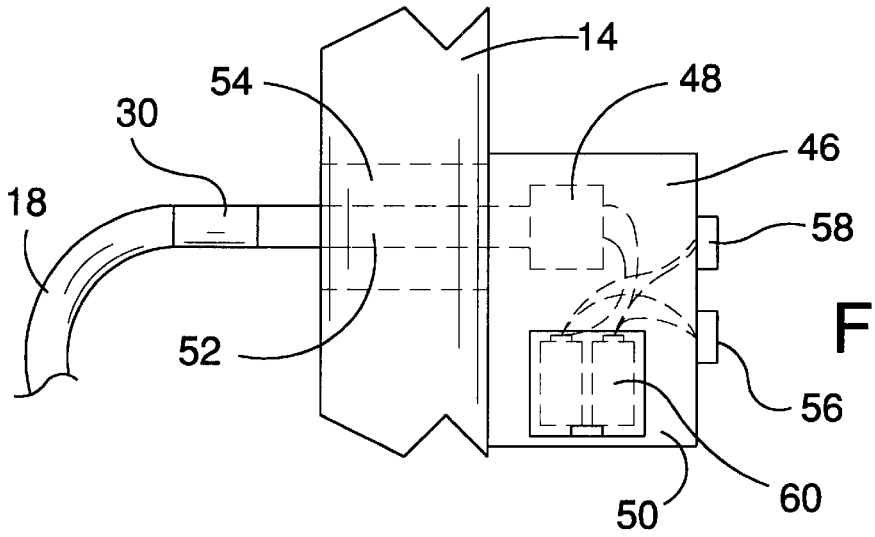
FIG. 5 is a front elevation view of the optional motorized version of the present invention.

FIG. 5 presents a second embodiment of the automatic jump rope apparatus in which the rotation of the jump rope 18 is accomplished with a motorized unit 46. The motorized unit 46 replaces the spring assembly 26 and crank 32 and consists of a motor 48 housed in a weatherproof casing 50 which provides rotational force to the shaft 52. The shaft is housed in a bushing 54 for stability. On the external surface of the casing 50 are an ON/OFF switch 56 and a variable speed control 58. The motor 48 supplies rotational force to the jump rope 18 and is powered by a battery pack 60.

In use, it can now be understood that the user attaches one end of a jump rope to each pole. Should the jump rope apparatus be used on uneven ground, the poles can be removed from the base and driven into the ground to ensure stability. After ascertaining that the control handle is pushed into the keyed opening, the user turns the crank until sufficient pressure is placed on the spring. The user then pulls the handle out from the keyed opening and proceeds to jump rope. The cranking procedure is repeated as often as is necessary. In the motorized version of the jump rope apparatus, the user simply sets the speed control and turns the device on once the jump rope has been attached to the apparatus.

While a preferred embodiment of the jump rope apparatus has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material which is treated to withstand the elements such as metal, heavy duty rubber, or a variety of wood may be used instead of the plastic poles described. Also, the metal hook and connector may be made of heavy-duty plastic, wood, or similar material.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A jump rope apparatus comprising:

a plurality of base units each having a top and a bottom and formed such that an aperture exists in the center of said top, said aperture formed through only part of said base unit;

a plurality of vertical support units each having two ends and attached to said base units by insertion of said end in said aperture;

a spring assembly attached to said vertical support for the purpose of providing the rotational force necessary to turn a jump rope;

a crank attached to said spring assembly;

a connector attached to said vertical support having said spring assembly attached for the purpose of connecting one end of a jump rope to said spring assembly;

a swivel unit attached to said other vertical support; and a loop connector attached to said swivel unit for the purpose of connecting the other end of a jump rope to said swivel unit;

wherein said vertical support unit with said spring assembly attached is formed such that a transverse aperture exists such that said spring assembly is attached to said vertical support unit at said transverse aperture; and wherein said spring assembly comprises:

a housing having an internal and external surface;

a coil spring having two ends and attached on said end to said internal surface of said housing;

a cylindrical shaft having two ends and formed such that it has a keyed opening along the transverse axis and inserted into said transverse opening of said vertical support member and attached on said end to said crank and on said opposite end to said connector;

a bearing of cylindrical shape and formed such that it fits snugly around said shaft;

a rod having two ends and a keyed stop member and formed such that said keyed stop member fits in said keyed opening of said shaft and attached on said end to said shaft and said spring such that when said rod is inserted into said keyed opening of said shaft, said keyed stop member engages said opposite end of said coil spring such that tension can be applied to said coil spring by said crank and said tension can be maintained;

a handle connected to said opposite end of said rod such that a user can easily insert said rod into said keyed opening of said shaft and pull said rod out again.

2. The jump rope apparatus of claim 1 wherein said housing is of a cylindrical shape and is of such dimension that the diameter is slightly larger than that of said coil spring.

3. The jump rope apparatus of claim 1 wherein said rod exists in a perpendicular plane to said shaft, both said rod and said shaft existing in a transverse direction to said vertical support unit.

* * * * *